US009308405B2

(12) United States Patent
Kameishi et al.

(10) Patent No.: US 9,308,405 B2
(45) Date of Patent: Apr. 12, 2016

(54) SPRINKLER HEAD

(75) Inventors: Hirotaka Kameishi, Tokyo (JP); Masashi Murakami, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 312 days.

(21) Appl. No.: 13/575,179

(22) PCT Filed: Jan. 26, 2011

(86) PCT No.: PCT/JP2011/051523

§ 371 (c)(1),
(2), (4) Date: Jul. 25, 2012

(87) PCT Pub. No.: WO2011/093348

PCT Pub. Date: Aug. 4, 2011

(65) Prior Publication Data

US 2012/0285707 A1 Nov. 15, 2012

(30) Foreign Application Priority Data

Jan. 28, 2010 (JP) ..... 2010-016688
Oct. 21, 2010 (JP) ..... 2010-236824

(51) Int. Cl.
*A62C 31/02* (2006.01)
*A62C 37/12* (2006.01)

(52) U.S. Cl.
CPC ..... *A62C 31/02* (2013.01); *A62C 37/12* (2013.01)

(58) Field of Classification Search
CPC ..... A62C 37/10; A62C 31/02; A62C 37/12
USPC ..... 169/39, 37, 42, 40, 41, 90, 468, 79, 72; 239/265.15
See application file for complete search history.

(56) References Cited

U.S. PATENT DOCUMENTS 4,015,665 A * 4/1977 Simons et al. ..... 169/40
4,214,631 A * 7/1980 Hattori ..... 169/57

(Continued)

FOREIGN PATENT DOCUMENTS

JP 2-109661 9/1990
JP 8-173571 7/1996

(Continued)

OTHER PUBLICATIONS

International Search Report issued Feb. 22, 2011 in International (PCT) Application No. PCT/JP2011/051523.

(Continued)

*Primary Examiner* — Ryan Reis
*Assistant Examiner* — Chee-Chong Lee
(74) *Attorney, Agent, or Firm* — Wenderoth, Lind & Ponack, L.L.P.

(57) ABSTRACT

A sprinkler head 1 includes a head body 10 having a water discharging cylinder 16 in the interior thereof, a frame 20 connected to the head body 10, a valve body 30 provided in the interior of the frame 20 and closing a water discharging port 12 of the water discharging cylinder 16, a thermosensitive portion 51 configured to support the valve body 30, and a disk spring 64 provided between the valve body 30 and the thermosensitive portion 51. A set screw 65 to be coupled to the thermosensitive portion 51 is provided under the valve body 30, and the set screw 65 is inserted into a through hole 64*a* at the center of the disk spring 64. The set screw 65 includes a head portion and a leg portion, and the head portion is formed to be higher than the height of the disk spring 64.

7 Claims, 13 Drawing Sheets

(56) References Cited

U.S. PATENT DOCUMENTS

| | | | | | |
|---|---|---|---|---|---|
| 4,228,859 | A | * | 10/1980 | Hattori | 169/57 |
| 4,651,832 | A | * | 3/1987 | Kubo | 169/39 |
| 4,766,961 | A | * | 8/1988 | Macie | 169/38 |
| 5,094,298 | A | * | 3/1992 | Polan | 169/41 |
| 5,373,989 | A | * | 12/1994 | Hattori | 239/71 |
| 5,924,492 | A | | 7/1999 | Kikuchi et al. | |
| 2005/0151310 | A1 | | 7/2005 | Rodeffer | |

FOREIGN PATENT DOCUMENTS

| | | |
|---|---|---|
| JP | 10-71215 | 3/1998 |
| JP | 10-179789 | 7/1998 |
| JP | 2000-79182 | 3/2000 |
| JP | 2004-324722 | 11/2004 |
| JP | 2008-75877 | 4/2008 |

OTHER PUBLICATIONS

Japanese Office Action issued Jun. 11, 2013 in Japanese Patent Application No. JP2010-16688.

Japanese Office Action issued Jun. 4, 2013 in Japanese Patent Application No. JP2010-236824.

* cited by examiner

Active (a)

(b)

(a)

(b)

SPRINKLER HEAD

TECHNICAL FIELD

The present invention relates to a sprinkler head.

BACKGROUND ART

Among sprinkler heads of the related art, there is a type of sprinkler head provided with a spring member such as a disk spring in a frame. The spring member is used for compensating fluctuation of an assembly load in the interior thereof or causing a member such as a stopper ring or the like to drop off.

There is also a type of sprinkler head that employs a disk spring for maintaining a state in which a valve body is in press-contact with a valve seat at the time of water discharge operation (for example, see Patent Document 1).

In the sprinkler head of the related art, a predetermined stroke is provided for the disk spring in order to prevent water leakage during an operation in the event of a fire. In order to provide a predetermined stroke, the disk spring having a plurality of through holes in the radial direction is used, and two of such disk springs are combined and integrated by connecting coupling holes at the centers of the two disk springs with respect to each other with a rivet. The integrated two disk springs are stored in a cylindrical tubular member provided inside the frame.

CITATION LIST

Patent Literature

PTL 1: Japanese Unexamined Patent Application Publication No. 8-173571

SUMMARY OF INVENTION

Technical Problem

The integrated disk springs are provided between a valve body and a dismantling portion holder which corresponds to a piston member. However, when an assembly load of a sprinkler head is large, the disk springs are crushed, and problems that the disk springs are not restored to their original shapes or become damaged may occur.

Also, since the disk springs are simply stored in a cylindrical tubular member, there is a problem in that the positioning cannot be fixed.

In order to solve the above-described problem, it is an object of the present invention to provide a sprinkler head in which damage of a disk spring due to an excessive load applied thereon is prevented.

Also, it is another object of the preset invention to provide a sprinkler head which is capable of holding the disk springs stably at a predetermined position.

Solution to Problem

In order to achieve the above-described object, the present invention provides a sprinkler head including: a head body having a water discharging cylinder in the interior thereof; a frame connected to the head body; a valve body configured to close a water discharging port of the water discharging cylinder in the interior of the frame; a thermosensitive portion configured to support the valve body; and a disk spring provided between the valve body and the thermosensitive portion, characterized in that a set screw configured to be coupled to the thermosensitive portion is provided below the valve body, and the disk spring is formed with a through hole at the center thereof, and the disk spring is held by allowing the set screw coupled to the thermosensitive portion to be inserted into the through hole.

In the sprinkler head according to the present invention, the set screw to be coupled to the thermosensitive portion is provided under the valve body, and the set screw is inserted into the through hole at the center of the disk spring. Therefore, the disk spring, being positioned by the set screw, does not move in the frame.

The present invention is characterized in that the set screw includes a head portion for forming a gap for clamping the disk spring at a predetermined load between the valve body and an opposing surface on the side of the thermosensitive portion opposing the valve body.

According to the present invention, since the head portion of the set screw forms the gap for clamping the disk spring at a predetermined load between the valve body and the opposing surface on the side of the thermosensitive portion opposing the valve body, the head portion serves as a spacer and prevents the disk spring from being applied with an excessive assembly load and hence being collapsed. Accordingly, the breakage of the disk spring due to excessive application of the load thereto may be prevented.

The present invention is characterized in that the set screw includes a head portion and a leg portion, and the head portion is formed to be larger in height than the height of arrangement of the disk spring held by the set screw.

The set screw includes the head portion and the leg portion, and the height of the head portion is formed to be larger than the height of the arrangement of the disk spring. Therefore, the disk spring is not collapsed more than necessary at the time of assembly, and the disk spring can be held in a stable state.

The present invention is characterized in that the through hole of the disk spring is formed to be substantially the same as or slightly larger than the outer diameter of the head portion of the set screw.

Since a through hole of the disk spring is formed to have a diameter substantially the same as the outer diameter of the head portion or slightly larger, arrangement of the disk spring with the center thereof displaced at the time of assembly is prevented, so that the disk spring can be held stably.

The present invention is characterized in that the disk spring includes a portion formed on an outer peripheral portion for receiving a load and a deflecting portion formed on an inner peripheral portion thereof.

Therefore, by changing these two portions with a balanced manner, a load to be applied to the disk spring and the amount of deflection thereof may be controlled arbitrarily.

The present invention is characterized in that the disk spring includes a plurality of slits extending radially from the through hole as a center.

Since the disk spring may have the plurality of slits extending radially from the through hole as the center, a load to be applied to the disk spring and the amount of deflection thereof may be controlled arbitrarily, and hence breakage of the disk spring due to the concentration of the stress can be prevented.

The present invention is characterized in that the disk spring includes through holes being triangular and formed into an arcuate shape at the corners thereof provided between the adjacent slits.

By providing the through hole in the disk spring, the stress applied to respective portions of the disk spring can be dispersed. Accordingly, problems that a large stress is generated and hence the disk spring is broken or the cracks may be generated when a large load (or a large stress) is applied may be solved.

The present invention is characterized in that a hole which allows insertion and engagement of the head portion of the set screw is provided at a bottom portion of the valve body opposing the head portion of the set screw.

According to the present invention, the valve body and the set screw can be assembled correctly, for example, concentrically, so that the resolution operation can be performed reliably.

The present invention is characterized in that a hole allowing insertion of the head portion of the set screw and having a gap which allows inclining action of the head portion of the set screw at the time of resolution operation with respect to the head portion is provided at a bottom portion of the valve body opposing the head portion of the set screw.

According to the present invention, with the provision of the gap which allows inclination of the head portion in the interior of the hole between the head portion of the set screw and the hole, the problems that the set screw is inclined at the time of resolution operation and hence is caught in the interior of the hole, thereby becoming languorous can be avoided. Therefore, the resolution operation can be performed reliably.

The present invention is characterized in that the head portion of the set screw is formed into an end chamfered shape or a curved surface shape.

In this configuration, even when the resolution operation is performed with the set screw in an inclined state, the head portion has the chamfered shape or the curved surface shape, and has a shape which can hardly be caught, the problems that the set screw is caught in the interior of the hole, thereby becoming languorous can be avoided further reliably.

The present invention is characterized in that a washer having a diameter larger than the diameter of the disk spring and comes into contact with the outer peripheral portion of the disk spring is provided between the disk spring and the valve body.

When the valve body is inclined at the time of the resolution operation, water may be leaked from the water discharging cylinder, and splash on the thermosensitive portion, whereby the operation may be stopped. According to the present invention, the washer and the outer peripheral portion of the disk spring come into contact with each other, and hence the load can be applied uniformly to the washer from the outer peripheral portion of the disk spring. Therefore, even when the resolution operation is performed with the set screw in the inclined state, the valve body can be held so as not to be inclined by the washer which receives a uniform load, and hence the problems as described above may be avoided.

The present invention is characterized in that the disk spring has a shape protruding on the center side with respect to the outer peripheral portion, and is arranged with the surface on the protruding side faced toward the thermosensitive portion.

According to the present invention, when the resolution operation is performed with the set screw in the inclined state, since the disk spring is arranged with the surface on the protruding side faced toward the thermosensitive portion, the inclination of the set screw can be absorbed by the disk spring portion, and the washer can be prevented from being inclined. Therefore, even when the resolution operation is performed with the set screw in the inclined state, the valve body can be held so as not to be inclined by the washer which receives a uniform load, and hence the problems as described above may be avoided.

Advantageous Effects of Invention

According to the sprinkler head of the present invention, damage of the disk springs due to an excessive load applied thereto is prevented, so that the disk spring can be held stably. Accordingly, the fire fighting operation can be performed reliably and stably.

DESCRIPTION OF EMBODIMENTS

First Embodiment [FIG. 1 to FIG. 10]

Figure 1:
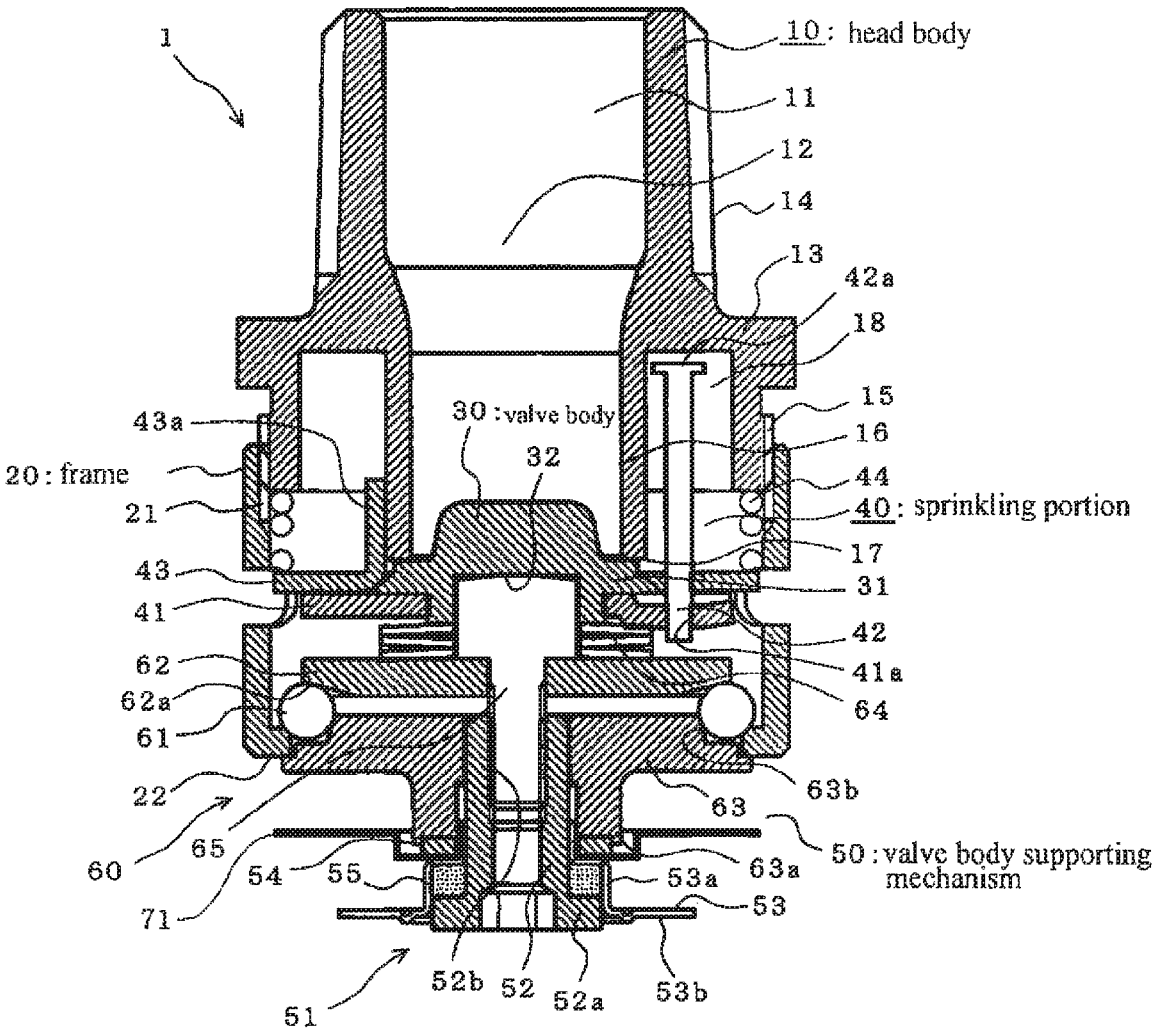
FIG. 1 is a vertical cross-sectional view of a sprinkler head according to a first embodiment of the present invention.

FIG. 1 is a vertical cross-sectional view of a sprinkler head according to a first embodiment of the present invention.

A sprinkler head 1 includes a head body 10, a frame 20, a valve body 30, a sprinkling portion 40, and a valve body supporting mechanism 50 (ball holding mechanism 60).

The head body 10 is opened at a center portion thereof. An opening portion 11 forms a water discharging port 12 together with a water discharging cylinder 16, described later. Formed on an outer peripheral portion of the head body 10 is a flange 13, formed on the outer peripheral portion of the head body 10 on an upper side of the flange 13 is a screw portion 14 to be connected to a water supply pipe, and formed on an outer peripheral portion of a lower side of the flange 13 is a screw portion 15 for allowing attachment of the frame 20, described later.

Formed inside the head body 10 is the cylindrical water discharging cylinder 16 projecting downward. Also, for example, a valve seat 17 formed into a flat shape is formed at a lower end portion of the water discharging cylinder 16, and is closed by the valve body 30. A shoulder which allows an outer periphery of the valve body 30 to fit thereon may be provided at the lower end portion of the water discharging cylinder 16. The head body 10 is formed with a substantially hole-shaped or a substantially ring-shaped space 18 between an inner peripheral portion of the lower side of the flange 13 and the water discharging cylinder 16 and a guide rod 42, described later, is stored in the space 18.

The frame 20 is formed into a cylindrical shape. A screw portion 21 is formed on an inner peripheral portion of an upper portion of the frame 20, and is engaged with the screw portion 15 formed on the side of a lower portion of the head body 10. Provided on a lower portion of the frame 20 is a locking shoulder portion 22 projecting inward, and balls 61, described later, will be locked in the locking shoulder portion 22.

The valve body 30 is formed into a protruding shape, includes a flange portion 31 at a lower portion thereof, and the valve seat 17 of the head body 10 is closed by the flange portion 31. The valve seat 17 may be provided with a Teflon (registered trademark) sheet or coated by Teflon (registered trademark). For reference, the valve body 30 is formed with a depression 32 at the center of the lower portion, and allows a head portion of a set screw 65, described later, to be inserted herein. The valve body 30 is supported by the valve body supporting mechanism 50, described later.

The sprinkling portion 40 is provided with a deflector 41, the guide rods 42, and a stopper ring 43 (and the valve body 30). The sprinkling portion 40 is provided in the frame 20. For reference, the deflector 41 may be provided on the lower portion of the frame 20, and hence at least part of the sprinkling portion 40 is provided in the interior of the frame 20.

The deflector 41 is formed of a disk having an opening portion at the center thereof, and is attached (fixed) to a lower surface of the flange portion 31 of the valve body 30 in a state in which the lower portion of the valve body 30 is inserted into the opening portion. Also, the deflector 41 is formed with (three, for example) insertion holes 41*a* which allow insertion of (three, for example) the guide rods 42, and lower ends of the guide rods 42 are secured to the deflector 41 in a state of being projected from the insertion holes 41*a*. Therefore, the valve body 30, the deflector 41, and the guide rods 42 are formed integrally.

Here, the state in which the deflector 41 is mounted on the valve body 30 will be described in detail. The valve body 30 includes the flange portion 31 which comes into contact with the valve seat 17 for keeping the water cut off, and a cylindrical leg portion projecting downward from the flange portion 31. An upper portion of the leg portion is formed into a groove portion having a diameter slightly smaller than a center opening portion (hole) of the deflector 41, and a lower side of the groove portion is formed into a cylindrical shape having a diameter slightly larger than the hole diameter of the center opening portion of the deflector 41. Therefore, the deflector 41 is in a rotatable state at a position connected to the valve body 30 (the groove portion).

Figure 10:
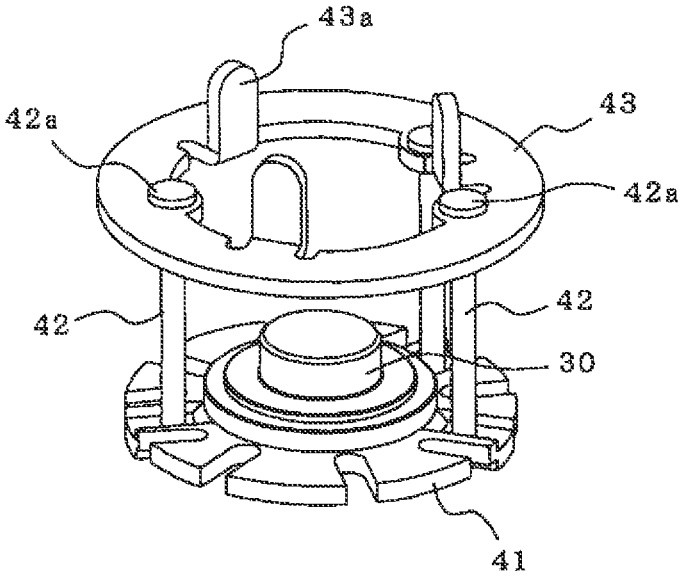
FIG. 10 illustrates perspective views of a stopper ring.
Figure 10:
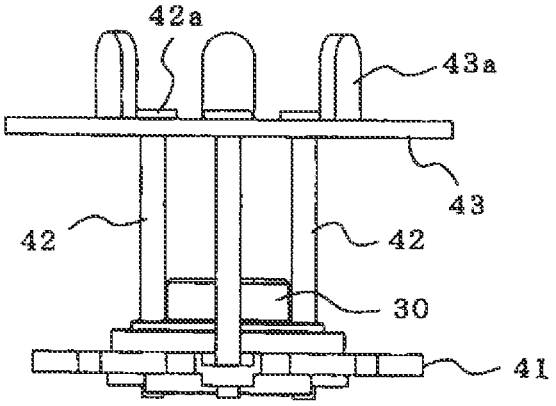

The guide rods 42 are each formed with a shoulder 42*a* widened in diameter for a stopper at an upper end thereof, and the stopper ring 43 formed into a doughnut shape is attached to the guide rods 42 so as to be movable in the vertical direction (see FIG. 10).

The stopper ring 43 is provided with (three, for example) insertion holes for allowing the guide rods 42 to be inserted thereto and, the stopper ring 43 is attached to the guide rods 42 so as to be movable to the locking shoulder portion 22 using this insertion holes by sliding the stopper ring 43 along the guide rods 42 at the time of water discharge operation. From another perspective, the guide rods 42 are mounted on the stopper ring 43 so as to be movable downward along the insertion holes of the stopper ring 43 at the time of water discharge operation. For reference, this insertion hole is formed to be smaller than the shoulder 42*a*. In the normal state, the stopper ring 43 is installed on the deflector 41 and is provided at approximately the midsection of the frame 20 in the height direction at a position opposing a slit provided on the frame 20. For reference, the slit does not necessarily have to be provided at a position opposing the stopper ring 43.

In the normal state, a lower surface of the stopper ring 43 is pressed by a coil spring 44 and is located at a position substantially overlapping an upper surface of the deflector 41. However, at the time of water discharge operation, the deflector 41 and the guide rods 42 move downward, and the shoulder 42*a* at an upper end of the guide rods 42 moves downward until it comes into abutment with the stopper ring 43 (see FIG. 2(*c*)). The outer diameter of the stopper ring 43 is formed to be larger than the inner diameter of the locking shoulder portion 22 of the frame 20, and when the valve body supporting mechanism 50 drops at the time of water discharge operation, the stopper ring 43 is pressed by the coil spring 44, and moves downward to the locking shoulder portion 22 of the frame 20.

For reference, the coil spring 44 has a size (outer diameter) which comes into abutment with an inner peripheral surface of the frame 20, and is provided between a lower side of the outer peripheral portion of the head body 10 and an outer peripheral portion of the stopper ring 43, so that a large space is not necessary to install the coil spring 44.

The inner diameter of the hole provided at the center of the stopper ring 43 is formed to be slightly larger than the outer diameter of the water discharging cylinder 16. Then, the stopper ring 43 is formed with guide members 43*a* having an L-shaped cross section formed by bending parts of an inner periphery thereof upward via notched grooves, for example, at three points on the inner periphery. When the stopper ring 43 moves downward, the stopper ring 43 is guided by the guide members 43*a* to an outer periphery of the water discharging cylinder 16 formed on the lower portion of the head body 10. The number and the pitch of the guide members 43 are set as needed so as to allow the stopper ring 43 to move downward in a balanced manner.

The valve body supporting mechanism 50 includes a thermosensitive portion 51, the ball holding mechanism 60, a disk spring 64, and the set screw 65.

The thermosensitive portion 51 includes a plunger 52, a thermosensitive plate 53, and a heat insulating member 54.

The plunger 52 is formed into a cylindrical shape and is formed with a flange portion 52*a* on a lower portion thereof. Also, the flange portion 52*a* is formed with a lower surface thereof projecting from a lower surface of the thermosensitive plate 53. The plunger 52 is formed with a female screw 52*b* in the interior thereof, and a male screw on a leg portion of the set screw 65 is screwed therein, so that both are coupled to each other. A doughnut-shaped thermosensitive member (for example, solder or the like) 55 is inserted from above the plunger 52, and is placed on the flange portion 52*a* of the plunger 52. Provided on the thermosensitive member 55 is the thermosensitive plate 53 having a disk shape and a crank-shaped cross section. In other words, the thermosensitive plate 53 includes a protruding portion 53*a* configured to cover the thermosensitive member 55 provided on the flange portion 52*a* of the plunger 52, and a disk portion 53*b* continuing from the protruding portion 53*a* and extending in the direction orthogonal to an axial core of the head body 10. Then, a force for compressing the thermosensitive member 55 is applied to the thermosensitive plate 53 by the ball holding mechanism 60, described later.

The heat insulating member 54 formed into a doughnut shape is provided on an upper portion of the thermosensitive plate 53 and configured to prevent heat received by the thermosensitive plate 53 from escaping toward a balancer 63, described later. As shown in FIG. 1, a separate thermosensitive plate 71 having a larger diameter may be provided between the heat insulating member 54 and the thermosensitive plate 53 as needed.

The ball holding mechanism 60 includes the balls 61, a slider 62, the balancer 63, and the disk spring 64. For reference, the balancer 63 has a function of compressing the thermosensitive member 55, and hence has functions as a piston.

A lower portion of an outer periphery of the ball 61 is locked into the locking shoulder portion 22 of the frame 20. It is the slider 62 which holds the balls 61 from above in this state, and a force is applied from the slider 62 to the balls 61, and hence the force acts on the balls 61 in the direction of inward movement.

The balancer 63 is provided inside the balls 61, and restricts the movements of the balls 61 moving inward. Both of the slider 62 and the balancer 63 are formed into a disk shape, have a through hole at the centers thereof, and the plunger 52 penetrates through the through hole of the balancer 63. The outer diameter of the plunger 52 is slightly smaller than the inner diameter of the through hole of the balancer 63, and both of these members are not coupled. Also, the inner diameter of the through hole of the slider 62 is formed to be slightly larger than the outer diameter of the leg portion of the set screw 65, and both of these members are not coupled.

The balancer 63 includes a cylindrical portion having a through hole and a disk portion provided on an upper portion of the cylindrical portion combined to each other. The balancer 63 is formed with a shoulder on an outer periphery of a lower portion thereof. The shoulder on the outer periphery of the lower portion is configured to come into abutment with a shoulder provided on an inner periphery of a lower portion of the locking shoulder portion 22 of the frame 20 and, when an external force is applied from a lower side of the balancer 63, the impact is absorbed by this portion. Also, projecting from around the through hole on the lower portion of the cylindrical portion of the balancer 63 and around the through hole at the center is a shoulder 63*a* which allows fitting of the heat insulating member 54, and projecting from an upper portion of the disk portion of the balancer 63 is a ball-receiving shoulder 63*b* which can receive the balls 61.

A depression 62*a* is formed on a lower portion of an outer peripheral side of the slider 62, and the surface of the depression 62*a* that the balls 61 come into contact with is formed in a tapered shape (inclined portion) so as to taper inward as it goes downward.

Since a force causing the balls 61 to move inward is always applied to the balls 61 as described above, a force to move the balancer 63 downward and the slider 62 upward acts. Therefore, when the solder functioning as the thermosensitive member 55 is melted and flowed out, the balancer 63 moves downward and, accordingly, the balls 61 enter inwards and hence the locked state with respect to the locking shoulder portion 22 of the frame 20 is released. Therefore, the ball holding mechanism 60 drops down together with the thermosensitive portion 51. When the ball holding mechanism 60 drops downward, the valve body 30 and the stopper ring 43 or the like which constitute the sprinkling portion 40 drop down accordingly, so that water discharge is performed.

The set screw 65 is a bolt including a large-diameter head portion and a small-diameter leg portion, and when a lower portion of the leg portion is coupled with an upper portion of the plunger 52, the balancer 63 as the ball holding mechanism 60, the slider 62, and the thermosensitive portion 51 are integrated with each other.

Figure 9:
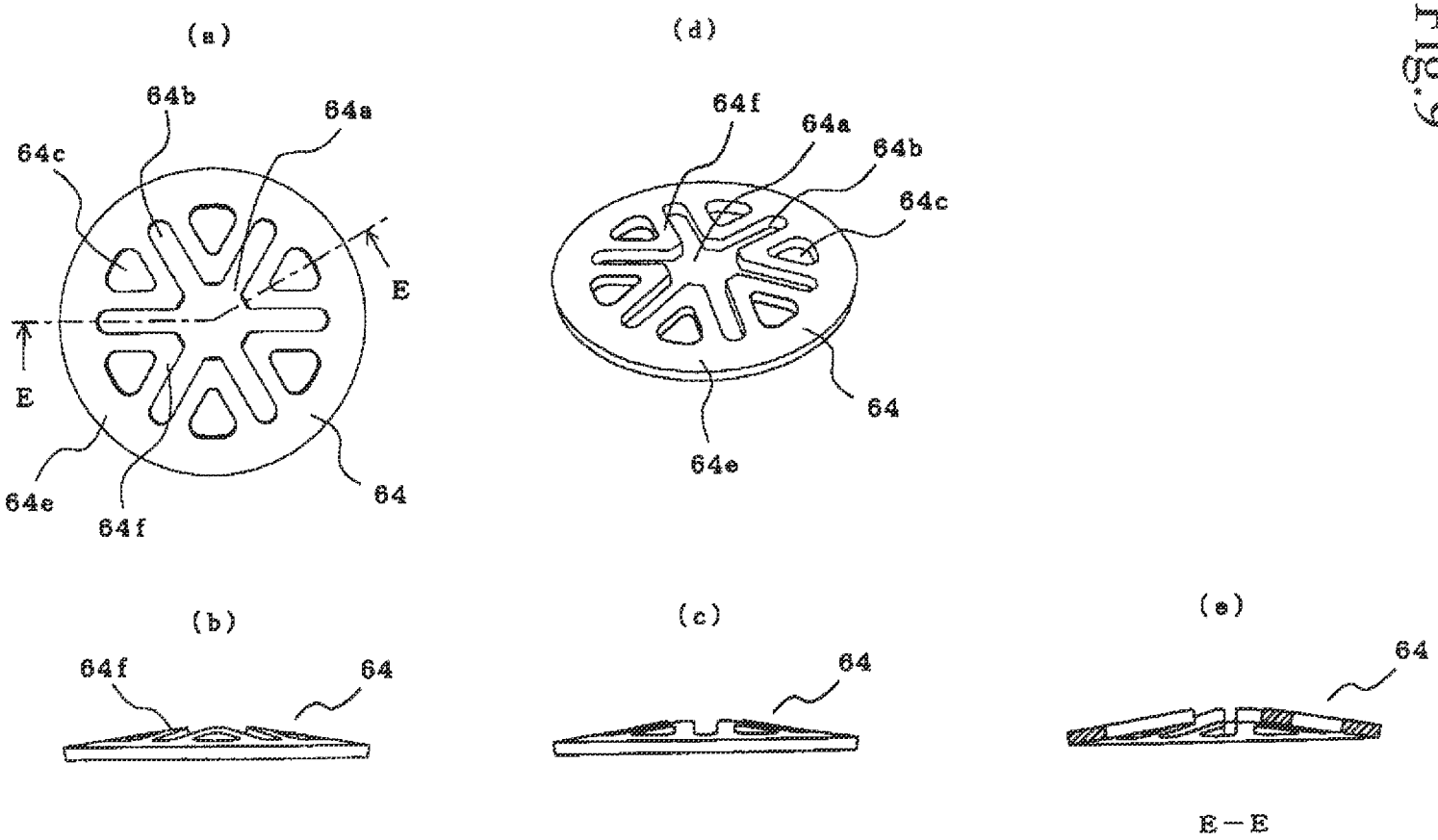
FIG. 9 shows a plan view, a front view, a side view, a perspective view, and a cross-sectional view taken along the line E-E of a disk spring shown in FIG. 1.

The disk spring 64 having a through hole 64*a* at the center thereof as shown in FIG. 9 is used. Then, slits 64*b* are provided from the through hole 64*a* at the center radially at regular intervals of 60°. Also, through holes 64*c* are provided between the slits 64*b*. The disk spring 64 is composed of one or a combination of a plurality of pieces and, for example, three pieces are combined in the vertical direction and are arranged between the valve body 30 and the slider 62. For reference, detailed description of the disk spring 64 will be given later.

The disk spring 64 allows insertion of the set screw 65 in the interior of the through hole 64*a*, and is provided between the valve body 30 and the slider 62. In other words, the through hole 64*a* of the disk spring 64 is formed to be substantially the same as or slightly larger than the outer diameter of the head portion of the set screw 65. Also, the height of the head portion of the set screw 65 is formed to be larger than the free height of the stacked plurality of pieces of the disk spring 64, and serves as a guide when the disk springs 64 are stacked. When the height of the head portion of the set screw 65 is low, the disk springs 64 may not function if the disk springs 64 are collapsed more than necessary at the time of assembly. Therefore, by setting the height of the head portion of the set screw 65 so that such an event can be avoided, the disk springs 64 can be held in a stable state.

In a state shown in FIG. 1, in the sprinkler head 1 as described above, the water pressure of fire service water at the water discharging port 12 or an assembly load acts on the balls 61 and hence the balls 61 attempt to move inward (toward the center), the balls 61 are prevented from moving by the balancer 63, and the ball holding mechanism 60 holds the balls. Then, in this state, the disk springs 64 press the valve body 30 upward, and the valve body 30 seals the water discharging port 12 of the head body 10. Therefore, the sprinkler head 1 receives a supply of pressurized fire service water, but the fire service water does not leak out. Also, in the sprinkling portion 40, the deflector 41 is fixed to the valve body 30, and the guide rods 42 are fixed to the deflector 41 and, in the state in which the valve body 30 seals the water discharging port 12, the guide rods 42 are in a state of being stored in the space 18 of the head body 10.

The operation of the sprinkler head 1 shown in FIG. 1 will be described.

Figure 2:
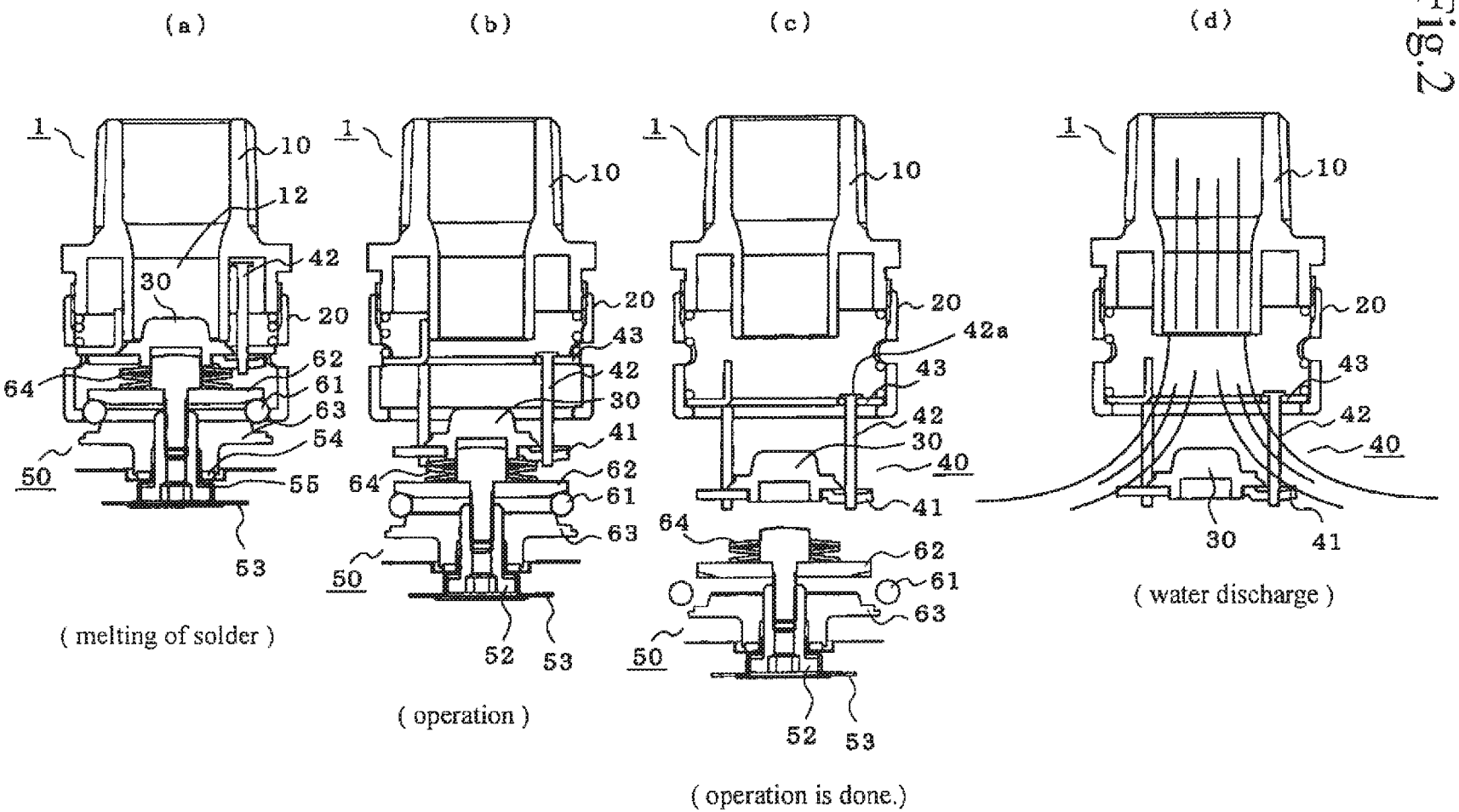
FIG. 2 illustrates cross-sectional views showing a state of operation of the sprinkler head shown in FIG. 1.

FIGS. 2(*a*) to (*d*) are drawings showing the process of operation of the sprinkler head 1.

(a) In a monitoring state of the sprinkler head 1, pressurized fire service water is supplied to the water discharging port 12 of the head body 10, and the pressure of the fire service water is applied to the valve body 30 (see FIG. 1). When a fire breaks out and hot air hits the thermosensitive plate 53, the thermosensitive plate 53 is heated and the heat of the thermosensitive plate 53 propagates to the thermosensitive member 55. Then, when the thermosensitive member 55 is heated from the periphery thereof and starts to melt, the melted thermosensitive member 55 flows out from a gap formed between the plunger 52 and the thermosensitive plate 53 (the protruding portion 53*a*) and the volume thereof is reduced (FIG. 2(*a*)).

At this time, the balls 61 pressed from above by the slider 62 are subjected to a force that causes the balls 61 to move inward and, as descried later, even when the balancer 63 moves downward toward the thermosensitive plate 53 and the balls 61 move, the valve body 30 is brought into press-contact with the valve seat 17, and a state in which the water discharging port 12 is closed is maintained. This occurs because of the action of the disk springs 64 and, by stacking a plurality of the disk springs 64, the disk springs 64 have a predetermined amount of stroke which is enough to maintain the sealed state by the valve body 30. In this manner, the valve body 30 is prevented from coming apart from the valve seat 17 until the ball holding mechanism 60 completely drops off, so that reliable operation is ensured.

(b) After the thermosensitive member 55 has melted and flowed to the outside, the thermosensitive plate 53 moves downward corresponding to the amount of outflow of the thermosensitive member 55. When the thermosensitive plate 53 moves downward, the heat insulating member 54 and the balancer 63 mounted on the thermosensitive plate 53 also move downward. When the balancer 63 moves downward, the gap between the balancer 63 and the slider 62 is increased, and the balls 61 urged inward move inward beyond the shoulder 63*b* of the balancer 63, so that the engagement between the locking shoulder portion 22 of the frame 20 and the balls 61 is released. Accordingly, the valve body 30 and the valve body supporting mechanism 50 move downward (FIG. 2(*b*)).

(c) When the valve body supporting mechanism 50 including the disk springs 64 arranged below the valve body 30 drops, the valve body 30 moves downward. Also, in association with the downward movement of the valve body 30, the deflector 41 attached to the valve body 30, the guide rods 42 attached to the deflector 41, and the stopper ring 43 move downward. When the guide rods 42 move downward, the shoulder 42*a* provided on an upper portion thereof is locked with the stopper ring 43, and the stopper ring 43 is locked with the locking shoulder portion 22 of the frame 20, and the valve body 30 and the deflector 41 are brought into a state of being suspended from the frame 20 by the guide rods 42 (FIG. 2(*c*)). For reference, at the time of this operation, there may be a case where the stopper ring 43 moves downward together with the guide rods 42 until being locked with the locking shoulder portion 22, and after the stopper ring 43 has become locked, only the stopper ring 43 moves further downward.

In this embodiment, in the water discharge operation, the deflector 41 moves downward together with the guide rods 42 while being guided by the guide member 43*a*, so that the operation of the deflector 41 moving downward is performed smoothly. Also, by providing the stopper ring 43 at approximately a midpoint of the frame 20 in the height direction, the amount of downward movement of the stopper ring 43 itself can be reduced, so that the operation at the time of water discharge is smoothened.

Incidentally, the guide member 43*a* of the stopper ring 43 is folded upward, and hence an obstacle of sprinkling of water at the time of water discharge hardly occurs. This point will be described. Some of the guide members of the related art are bent downward. In this case, if the guide member is long or thick and water impinging upon the valve body splashes at the time of water discharge, water impinges upon the guide member and hence the guide member becomes the obstacle of sprinkling of water. In other words, the guide member 43*a* is bent upward to increase the distance from the valve body 30 at the time of water discharge, whereby the guide member 43*a* is prevented from becoming the obstacle of sprinkling of water.

(d) In this manner, when the valve body 30 moves downward, the water discharging port 12 is opened, and the pressurized fire service water is sprinkled via the deflector 41 and extinguishes the fire (FIG. 2(*d*)).

Subsequently, characteristic parts of the plunger 52, the slider 62, and the disk springs 64, which are the respective components which constitute the sprinkler head of the present invention will be described respectively in detail.

(Plunger 52)

Figure 3:
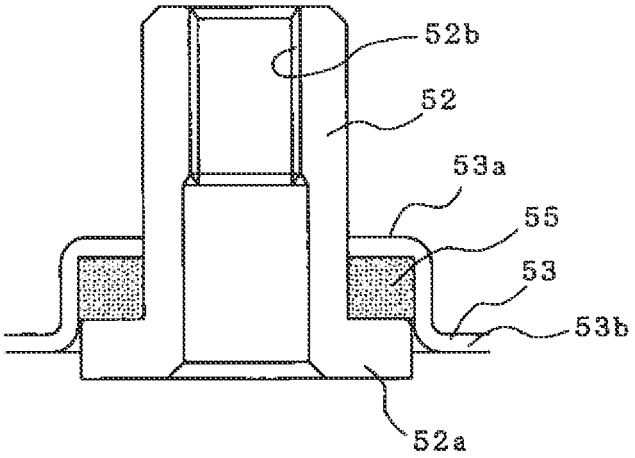
FIG. 3 is a cross-sectional view showing a plunger in FIG. 1 in detail.

FIG. 3 is a cross-sectional view showing the plunger 52 in detail.

The plunger 52 in FIG. 1 is provided so that a distal end portion thereof projects downward from the thermosensitive plate 53 as described above. FIG. 3 shows the corresponding portion extracted from FIG. 1. When something hits on the sprinkler head 1 (especially from below), since the plunger 52 projects in this manner, the something is prevented from hitting on the plunger 52 and the something is prevented from hitting on the thermosensitive plate 53. Since the plunger 52 is formed of a member which increases the rigidity thereof in comparison with the thermosensitive plate 53, there is no probability of deformation. Therefore, there is no probability that the plunger 52 digs into the thermosensitive plate 53, and hence the malfunction does not occur.

Also, an upper end portion of the plunger 52 has a length reaching an upper end of the balancer 63 (see FIG. 1), and the set screw 65 and the plunger 52 are coupled, so that the rigidity is high. Therefore, even when an external force is applied to the sprinkler head 1 from the side, there is no probability of deformation of the plunger 52 or the set screw 65, and hence the malfunction does not occur. In particular, the shoulder provided on the outer periphery of the lower portion of the balancer 63 is locked with the shoulder on the inner periphery of the lower portion of the locking shoulder portion 22, and hence is robust over the external force from the side or from below, and the received external force is transferred to the frame 2.

Subsequently, an example of the plunger 52 configured to cope with the external force applied to the sprinkler head 1 from obliquely below will be described with reference to FIG. 4 to FIG. 6.

Figure 4:
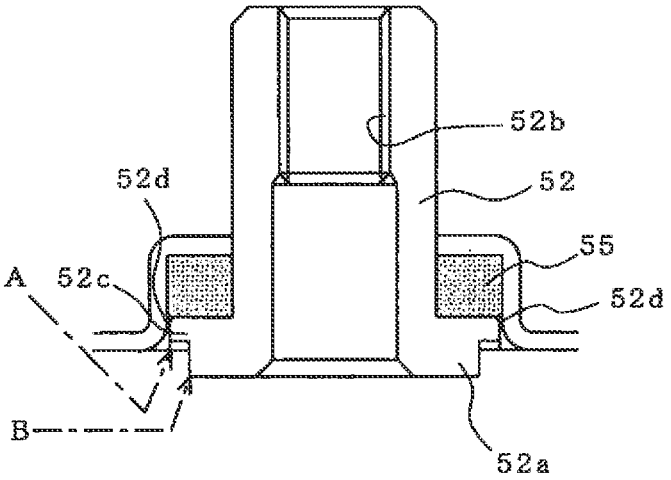
FIG. 4 is a cross-sectional view showing a (first) modification of the plunger.

FIG. 4 shows an example in which a shoulder 52*c* enlarged in diameter is provided on an upper portion of the flange portion 52*a* at a lower end of the plunger 52. In other words, it is an example in which a shoulder with a reduced diameter is provided on the lower portion of the flange portion 52*a*.

With the provision of the shoulder 52*c* as described above on the flange portion 52*a* of the plunger 52, the external force is applied firstly to a corner portion (point B), and hence a corner portion (point A) is prevented from being deformed due to the external forces from below and obliquely from below. Also, even when the corner portion (point B) is deformed, since the shoulder 52*c* enlarged in diameter is formed on an upper side of the deformed portion, the deformed portion is prevented from closing a gap 52*d* formed between the plunger 52 and the thermosensitive plate 53 and from causing the plunger 52 and the thermosensitive plate 53 to engage and couple to each other by deformation, so that the operability is not affected.

FIGS. 5(A) and (B) are examples in which a rounded R surface 52*e* or a taper (chamfered C surface) 52*f* is provided at a lower end of the flange portion 52*a* of the plunger 52.

Since the lower end of such a flange portion 52*a* of the plunger 52 is formed to have a smaller diameter than an upper portion of the flange portion 52*a*, even when the lower end portion is deformed by the external forces from below and the obliquely below, there is no probability that the deformed portion closes the gap 52*d* or causes the plunger 52 and the thermosensitive plate 53 to engage or couple to each other due to the deformation thereof, and the operability is not affected.

Figure 5:
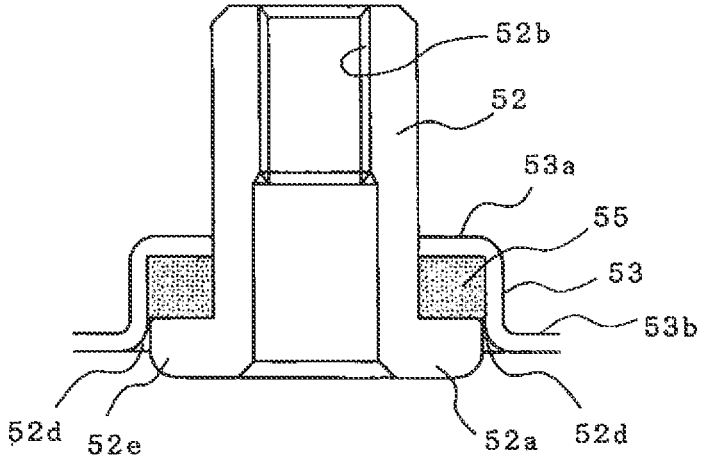
FIG. 5 illustrates cross-sectional views showing a (second) modification of the plunger.
Figure 5:
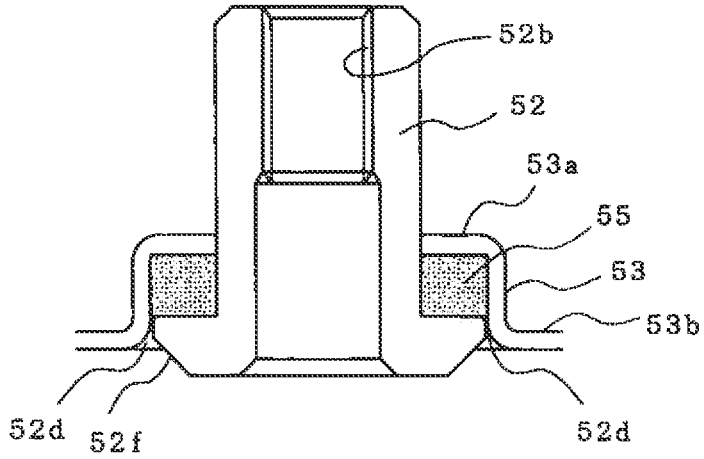
Figure 6:
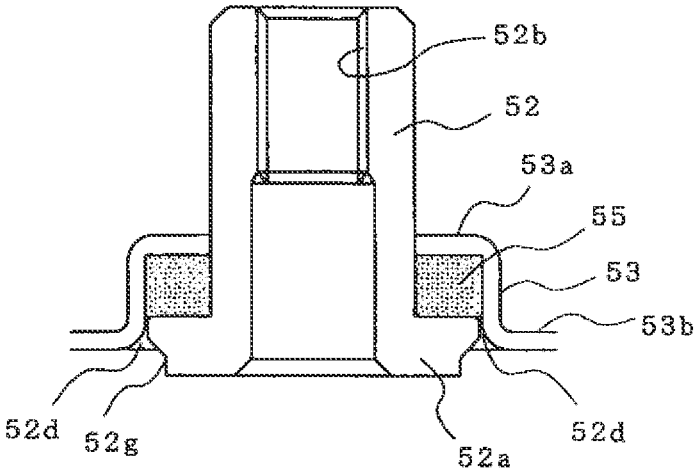
FIG. 6 is a cross-sectional view showing a (third) modification of the plunger.

FIG. 6 shows an example in which a shoulder is provided on an upper portion of the flange portion 52*a* of the plunger 52, and a taper 52*g* is provided on a lower portion thereof, which is a shape assembling the shapes shown in FIG. 4 and FIG. 5(B). Since the portion of the flange portion 52*a* of the plunger 52 is formed in such a manner, even when the lower end portion of the flange portion 52*a* is deformed by the external forces from below and the obliquely below, there is no probability that the deformed portion closes the gap 52*d* or causes the plunger 52 and the thermosensitive plate 53 to engage or couple to each other due to the deformation thereof, and the operability is not affected.

In this manner, the plunger 52 according to the present invention is provided with the shoulder, the tapered surface or the R-surface on the lower end of the flange portion 52*a*, even when the lower end portion is deformed by the external force from below or from obliquely below, the lower side of the flange portion 52*a* and the protruding portion 53*a* of the thermosensitive plate 53 are arranged at a predetermined gap. Therefore, in other words, a positional relationship that the lower side portion of the flange portion 52*a* is arranged so as to inscribe in the protruding portion 53*a* of the thermosensitive plate 53 via the predetermined gap is maintained, the operability is not affected even when the thermosensitive plate 53 is deformed by being applied with the external force. For reference, the gap may be filled with solder.

(Slider 62)

First of all, a configuration which is required for the sprinkler head 1 having the ball holding mechanism 60 including the slider 62, the balls 61, and the like. When the valve body 30 comes apart from the valve seat 17 before the balls 61 completely comes off from the locking shoulder portion 22 of the frame 20, there arises a risk of becoming inoperative due to the leakage during the operation. Therefore, a remaining load which supports the valve body is necessary in the sprinkler head 1. In order to secure the remaining load, it is necessary to suppress the amount of downward movement of the slider 62 (referred to as the operation stroke). Therefore, in the related art, by using the spring having the high amount of displacement such as the coil spring, the amount of displacement of the coil spring is set to be larger than the operation stroke of the slider 62, whereby leakage of water during the operation is prevented.

In the present invention, the operation stroke of the slider 62 is reduced by changing the shape of the slider 62, and the amount of displacement of the disk spring itself is increased by devising the shape of the disk springs 64, whereby the massive coil spring is no longer necessary to use.

Returning back to FIG. 1 now, when focusing on the shape of the slider 62, the surface of the depression 62*a* on the side of the outer peripheral portion of the slider 62, which comes into contact with the balls 61, is tapered, and the tapered surface is in contact with the balls 61.

With the employment of the slider 62 having such a shape, the amount of movement (operation stroke) in the axial direction of the slider 62 when the balls 61 enter inside the slider 62 and climb over the balancer 63 may be small in comparison with the case where the slider 62 is not provided with the depression on the inner side thereof and hence is flat (related art), and hence the amount of displacement required for the disk springs 64, that is, the stroke required for bringing the valve body 30 into press contact with the valve seat 17 until the balls 61 completely come off from the locking shoulder portion 22 can be reduced. A modification of the slider 62 will be described with reference to FIG. 7 and FIG. 8.

Figure 7:
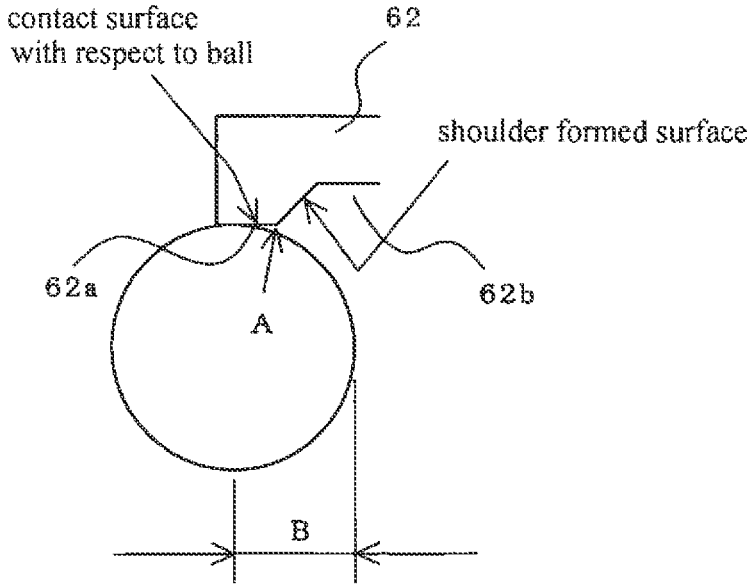
FIG. 7 is a cross-sectional view showing a (first) modification of a slider.

FIG. 7 is an example in which a recessed portion 62*b* for a ball is provided on the slider 62. The recessed portion 62*b* includes a depression formed on a lower surface of the slider 62. In this drawing, a point of the contact surface of the ball 61 where the shoulder formed surface starts (point A) is located on the side of the axial center of the head within a range from the position of the center of the ball at a distance equal to or smaller than the radius of the ball (within a range indicated by B). In FIG. 7, at the time of operation of the sprinkler head, when the ball 61 enters inside the slider 62, the ball 61 moves so as to enter the recessed portion 62*b*, and hence the ball 61 accelerates the operation of the balls 61 to move away from the locking shoulder portion 22, whereby the amount of movement of the ball 61 in the axial direction is reduced, thereby reducing the operation stroke.

Figure 8:
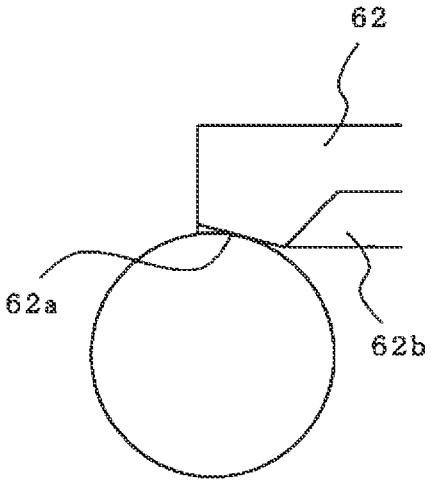
FIG. 8 is a cross-sectional view showing a (second) modification of the slider.

FIG. 8 is an example in which the taper is formed on a contact surface of the ball of the slider 62 in FIG. 7. The slider 62 is an example in which the taper surface in FIG. 1 and the recessed portion 62*b* in FIG. 7 are combined.

(Disk Spring 64)

Subsequently, the disk springs 64 in FIG. 1 will be described.

FIGS. 9(*a*), (*b*), (*c*), (*d*), and (*e*) show a plan view, a front view, a side view, a perspective view, and a cross-sectional view taken along the line E-E of the disk spring.

The main body of the disk spring 64 is formed with the through hole 64*a* at the center thereof, and the six slits 64*b* are provided radially uniformly at intervals of 60°. The slits 64*b* are formed so as to continue to the through hole and have substantially the same width from the through hole 64*a* at the center to a distal end portion on outer peripheral sides thereof. Provided between the adjacent slits are the fan-shaped (triangular shape with arcuate-shaped corners) through holes 64*c* widened on the outer peripheral side. An angle of the through hole 64*c* on the side of an inner periphery is formed to have a smallest angle, and the size of the through hole 64*c* is smaller than the through hole 64*a* at the center, and the width on the outer peripheral side is formed to be larger than the width of the slits 64*b*. The distance from the center of the disk springs 64 to the outer peripheral side of the through hole 64*c* and the distance from the center of the disk springs 64 to the outer peripheral side of the slits 64*b* are substantially the same.

Portions between the adjacent slits 64*b* are projecting portions 64*f* corresponding to the upright strips of the disk spring of the related art. The projecting portions 64*f* are inclined upward as it goes to the inner peripheral side, and is configured to function as a deflecting portion, described later. In other words, it may be said that the disk springs 64 have projections having a substantially triangle shape pointed on the inner peripheral side with the through hole 64*c*. For reference, the outer peripheral portion of the main body of the disk spring 64 is configured as the disk spring portion 64*e* which receives a load.

The disk springs 64 is provided with the six slits 64*b* as described above, and if the number of the slits 64*b* is as small as, for example, four (the related art), there arise problems that the stress is increased and hence the disk spring may be broken, may be result in buckling, or may be subject to a secular change. Also, there are as many as 10 or more slits 64*b* (the related art), there may arise problems that the load may become insufficient, the amount of deflection may become insufficient, or the disk spring cannot be restored to its original shape. In these reasons, in this embodiment, the number of slits 64*b* is set to, for example, six.

Also, the through holes 64*c* are provided between the slits 64*b*. This is to reduce the stress which is applied to the disk springs 64. When there are no through holes 64*c* between the slits 64*b*, when a large load (or a large stress) is applied, there may arise problems that a large stress is generated and hence the disk spring is broken or the cracks may be generated.

Also the shape of the through holes 64*c* between the slits has a triangular shape having arcuate-shaped (fan-shaped) corners. This is to disperse the stress applied to the respective parts. If the shape of the through holes is an elongated shape or a square as in the related art, the stress cannot be dispersed and hence the disk spring may be broken when a large load is applied thereto.

Also, advantages of the disk spring 64 described above will be described from another point of view.

The disk spring 64 is divided into a portion which receives the load and a deflecting portion formed on the inner peripheral portion (center side). The outer peripheral portion (the peripheral edge portion) of the disk spring 64 corresponds to the portion which receives the load, and the shape of the projecting portions 64*f* (slit portions) corresponds to the deflecting portion. By changing these two portions with a balanced manner, a load to be applied to the disk spring 64 and the amount of deflection thereof may be controlled arbitrarily. In addition, in order to disperse the stress, the breakage or the buckling may not occur. Therefore, both of the high load and the high amount of displacement, which cannot be achieved in the disk spring of the related art are achieved.

In this embodiment, the disk spring 64 having radial slits 64*b* and the through holes 64*c* provided between the slits 64*b* having a shape of a lotus root in cross section is used to secure the assembly load and the stroke required for the stopping water. However, the shape of the disk spring used in the sprinkler head is not limited to this shape. For example, it is also possible to use a single or a plurality of disk springs of a similar shape may be combined as needed as long as a stroke required for the assembly load and stopping water is provided and the corrosion resistance is taken into consideration.

Second Embodiment [FIG. 11 to FIG. 16]

Figure 11:
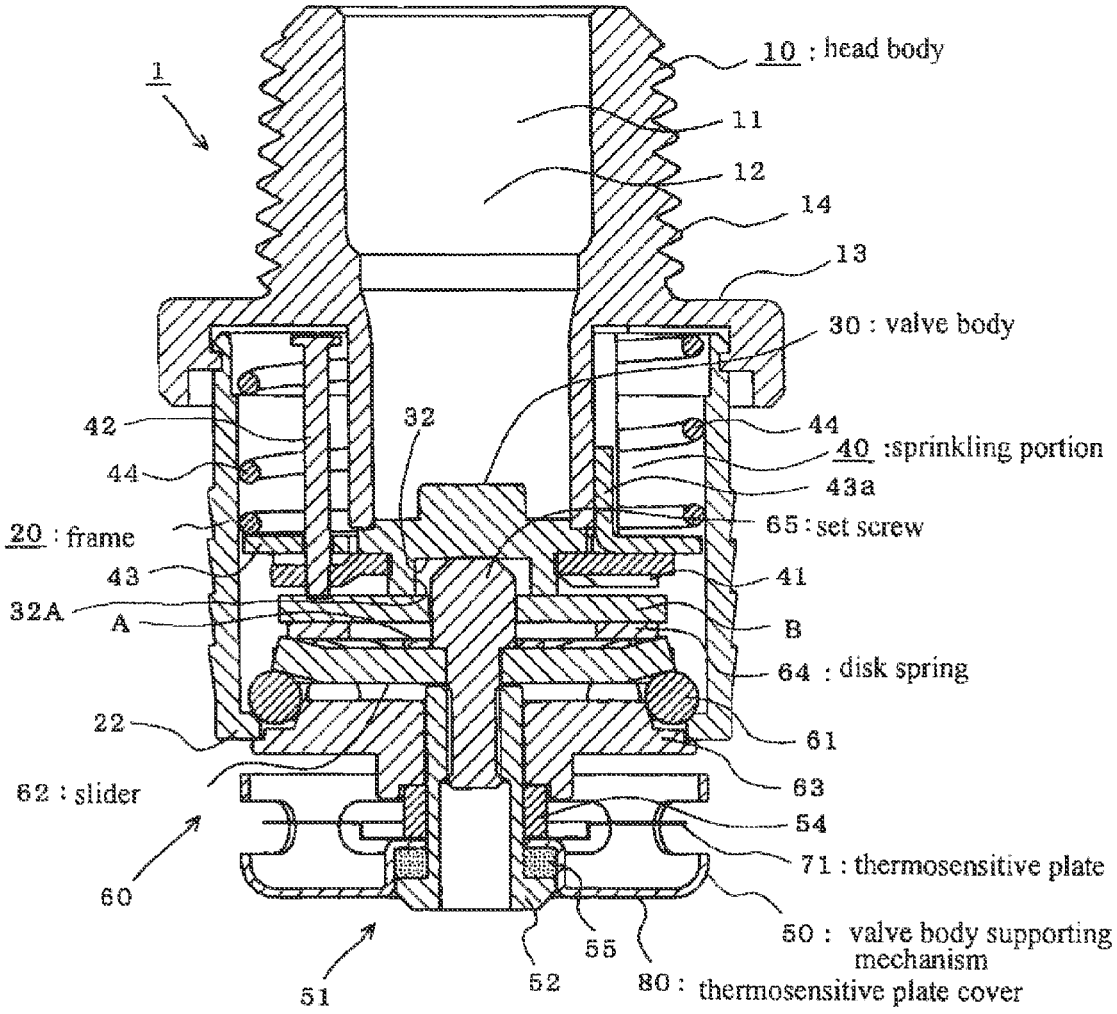
FIG. 11 is a vertical cross-sectional view of a sprinkler head according to a second embodiment of the present invention.
Figure 12:
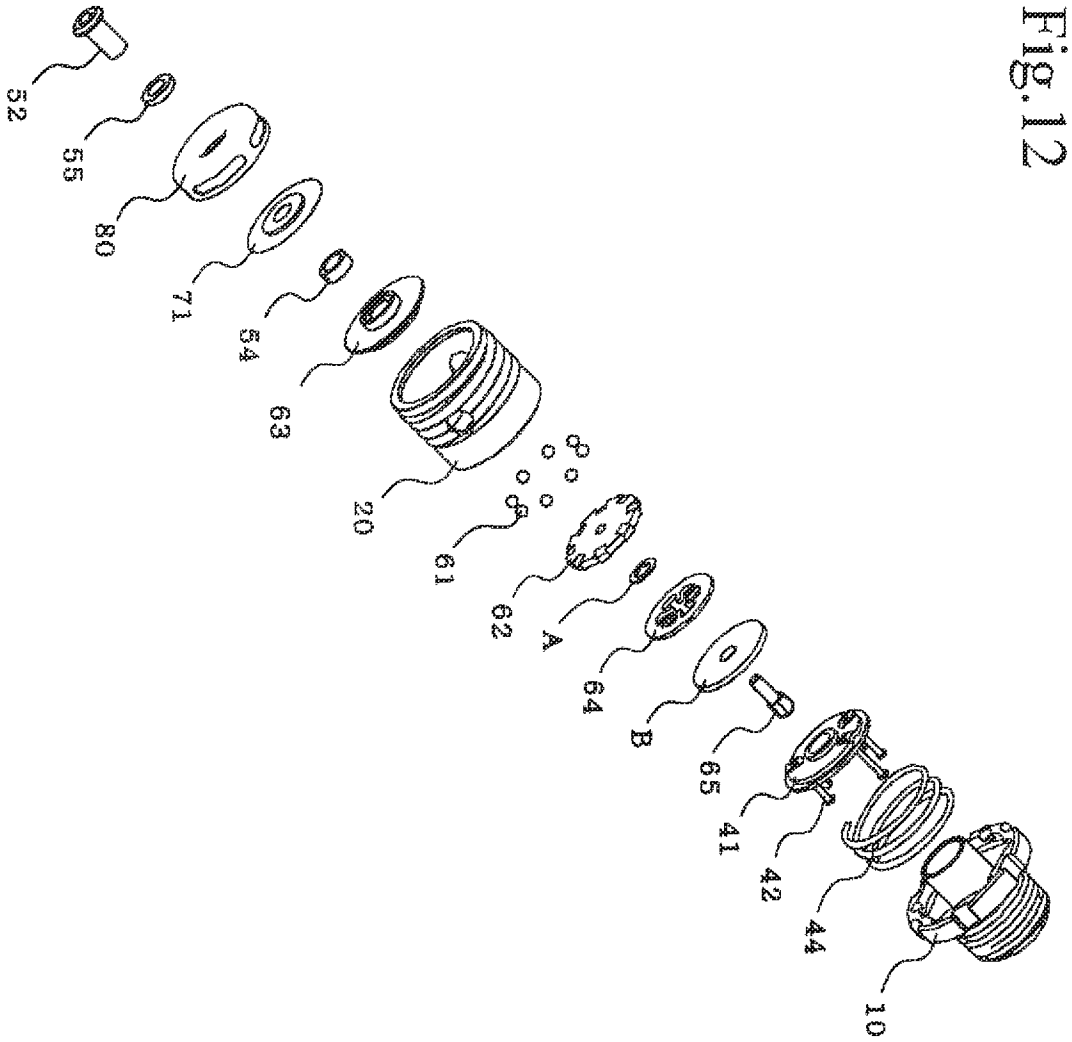
FIG. 12 is an exploded perspective view showing the sprinkler head shown in FIG. 11.

FIG. 11 is a vertical cross-sectional view of a sprinkler head according to a second embodiment of the present invention, and FIG. 12 is an exploded perspective view showing the sprinkler head shown in FIG. 11. In these drawings, the same reference numerals as those in FIG. 1 have the same name and the same function, and different points from the embodiments described above will mainly be described.

(Head Body 10)

The coupling relationship between the head body 10 and the frame 20 is that the head body 10 is formed with a female screw, and the frame 20 is provided with a male screw, and the male screw of the frame 20 engages the female screw of the head body 10 so that both are coupled. Therefore, in the coupling relationship between the head body 10 and the frame 20, the relationship between the male screw and the female screw is vice versa in comparison with the embodiment shown in FIG. 1.

(Valve Body 30)

The valve body 30 of the sprinkler head is the same in having a depression on the lower portion of the valve body 30 for allowing the upper portion of the set screw 65, but a washer B is provided between the disk spring 64 having the set screw 65 inserted therethrough and the valve body 30. The washer B has a doughnut shaped disk having a predetermined thickness. There are formed a lower end of the guide rod 42, and a wind (claw) of the deflector 41 formed on a portion opposing the guide rod 42 by being bent downward on lower surface of the deflector 41 of the sprinkling portion 40 as protruding portions as shown in FIG. 11. Therefore, with the provision of the washer B, the protruding portions on the lower surface of the deflector 41 are received by an upper surface of the washer B, so that a uniform force is applied to the disk spring 64.

(Sprinkling Portion 40)

The sprinkling portion 40 of the sprinkler head has the same basic configuration as that in the first embodiment shown in FIG. 1. However, the coil spring 44 is mounted between the upper portion of the space 18 of the head body 10 and the stopper ring 43, which is a different point from the example in FIG. 1.

(Plunger 52)

The plunger 52 has the same basic configuration as that in FIG. 5(*b*).

In other words, the plunger 52 of the valve body supporting mechanism 50 is provided so that the distal end portion thereof projects downward from a thermosensitive plate cover 80. When something hits on the sprinkler head 1 (especially from below), since the plunger 52 projects in this manner, the something is prevented from hitting on the plunger 52 and the something is prevented from hitting on the thermosensitive plate cover 80. Since the plunger 52 is formed of a member which increases the rigidity thereof in comparison with thermosensitive plate cover 80, there is no probability of deformation. Therefore, there is no probability that the plunger 52 digs into the thermosensitive plate cover 80, and hence the malfunction does not occur.

Also, the upper end portion of the plunger 52 has a length reaching the upper end of the balancer 63 (see FIG. 11), and the set screw 65 and the plunger 52 are coupled, so that the rigidity is high. Therefore, even when an external force is applied to the sprinkler head 1 from the side, there is no probability of deformation of the plunger 52 and the set screw 65, and hence the malfunction does not occur. In particular, the shoulder provided on the outer periphery of the lower portion of the balancer 63 is locked with the shoulder on the inner periphery of the lower portion of the locking shoulder portion 22, and hence is robust over the external force from the side or from below, and the received external force is transferred to the frame 20.

The taper (chamfered C surface) 52*f* is provided on the plunger 52 at the lower end of the flange portion 52*a* thereof. Since the lower end of the flange portion 52*a* of the plunger 52 is formed to have a smaller diameter than the upper portion of such a flange portion 52*a*, even when the lower end portion is deformed by the external forces from below and the obliquely below, there is no probability that the deformed portion closes the gap 52*d* or causes the plunger 52 and the thermosensitive plate cover 80 to engage or couple to each other due to the deformation thereof, and the operability is not affected.

(Thermosensitive Plate Cover 80)

Figure 13:
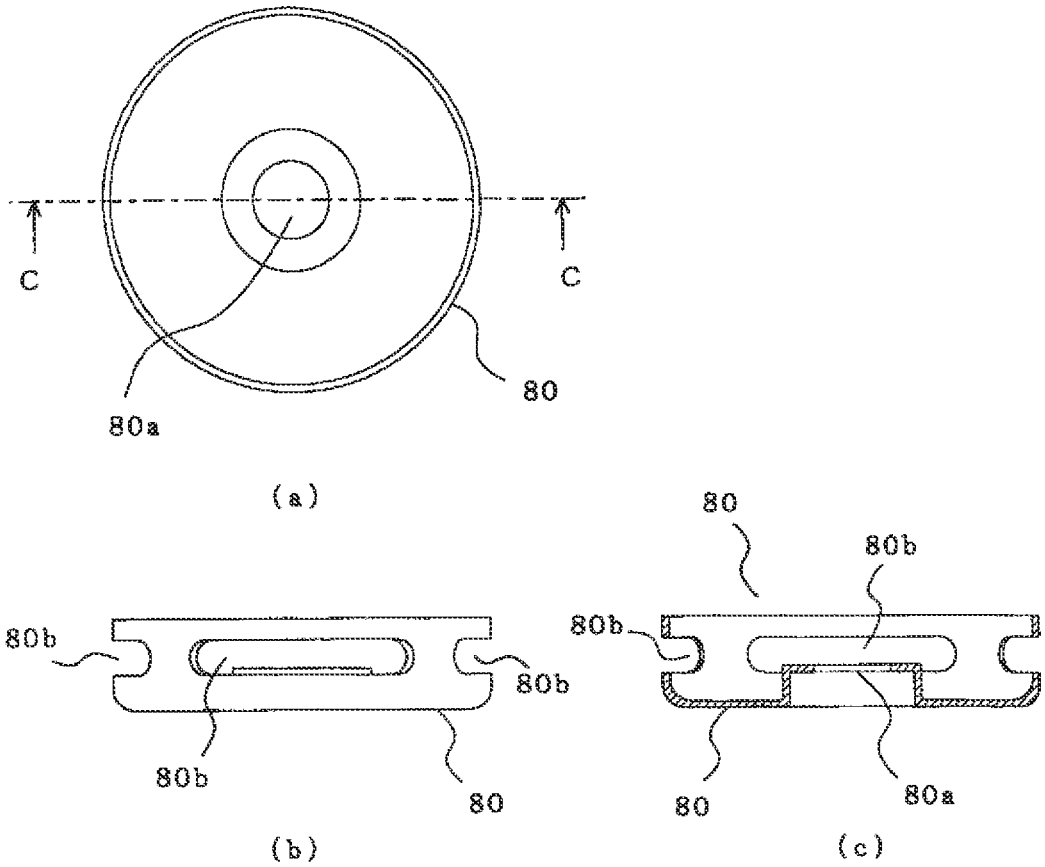
FIG. 13 shows a plan view, a front view, and a cross-sectional view taken along the line C-C of a thermosensitive plate cover shown in FIG. 11.

FIGS. 13 (*a*), (*b*), and (*c*) show a plan view, a front view, and a cross-sectional view taken along the line C-C of the thermosensitive plate cover 80.

The thermosensitive plate cover 80 is different from the first embodiment in that the thermosensitive plate 53 in the first embodiment is formed into a bowl shape so as to be capable of covering the thermosensitive plate 71 provided on an upper side. In other words, the thermosensitive plate cover 80 is formed into a bowl shape, and an upper portion of an annular side wall portion is opened, and an opening portion 80*a* which allows insertion of the plunger is formed at the center portion thereof. The side wall portion is formed with a slit-shaped opening portion 80*b* for taking outside air toward the thermosensitive plate 71. The thermosensitive plate cover 80 stores the thermosensitive plate 71, the opening portion 80*b* allows the peripheral edge portion of the thermosensitive plate 71 to be exposed so that the peripheral edge portion of the thermosensitive plate 71 is positioned at the center portion in the height direction (see FIG. 11), and hot air comes into direct contact with the peripheral edge portion of the thermosensitive plate 71. In this manner, the outer diameter of the thermosensitive plate 71 is used here as large as being substantially the same as the diameter of the locking shoulder portion 22 of the frame 20 on the inner peripheral side so that the hot air passing through the opening portion 80*b* hits directly thereon.

The thermosensitive plate 71 is formed into a flat panel shape as shown in FIG. 11 and FIG. 12, and is thermally connected to the thermosensitive member 55 via an outside portion of the opening 80*a* of the metallic thermosensitive plate cover 80. Then, the thermosensitive plate 71 is stored in the thermosensitive plate cover 80 as described above. For the reference sake, the thermosensitive plate 71 only has to be capable of transferring heat to the thermosensitive member 55. Therefore, as long as it is achieved, contact of the thermosensitive plate 71 to the thermosensitive member 55 may either be direct or indirect.

The thermosensitive plate cover 80 is formed of the metallic member, the lower portion thereof is formed so as to wrap the thermosensitive member 55 and to be in contact with the thermosensitive member 55 in the same manner as the thermosensitive plate 71 in FIG. 1 (see FIG. 11), and functions as the thermosensitive plate. The thermosensitive plate cover 80 serves to protect the thermosensitive plate 71 from the external force and when the same material as the thermosensitive plate 71 is used, the thickness is increased. For example, when the thickness of the thermosensitive plate 71 is from 0.05 mm to 0.1 mm, the thickness of the thermosensitive plate cover 80 is set from 0.2 mm to 0.3 mm.

For the reference sake, the height of the opening portion 80*b* of the thermosensitive plate cover 80 is designed so that a lower side of the opening portion 80*b* is almost the same as or lower than an upper surface of the thermosensitive member 55 and, the width of the opening portion 80*b* is formed to be larger than the outer diameter of the doughnut shaped thermosensitive member 55 (that is, the outer diameter of the plunger 52). Accordingly, the hot air passed through the opening portion 80*b* accelerates heating of the thermosensitive member 55.

The larger the surface area of the opening portion 80*b* of thermosensitive plate cover 80, or the larger the number of the opening portions 80*b*, the more the hot air is fed to the thermosensitive plate 71. However, from the facts that the hot air is flowed easier with the opening portions formed so as to oppose to each other, and that the larger the beam (columns) formed between the opening portion and the opening portion, the larger the resistance against the external force becomes (the stronger the strength becomes), the four opening portions 80*b* are provided at regular intervals in this embodiment.

(Slider 62)

Figure 14:
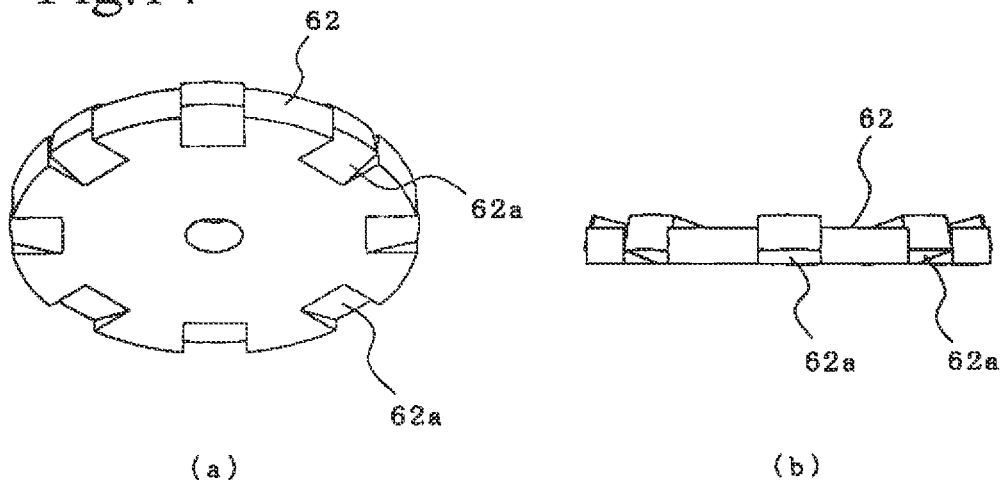
FIG. 14 shows a perspective view (a state viewed from below) and a front view of a slider shown in FIG. 11.

FIGS. 14(*a*), (*b*) are a perspective view and a front view of the slider 62 of the ball holding mechanism 60.

The slider 62 in the first embodiment is formed by cutting a lower surface of a flat plate over an entire circumference to form the depressions 62*a* as contact surfaces of the balls 61. In contrast, the slider 62 in this embodiment is formed by applying a pressing process on a flat plate. In other words, the depressions 62*a* are formed by bending portions of the contact surfaces with the balls 61 obliquely upward.

Provided between the slider 62 and the disk spring 64 is a washer A. The washer A is configured from a doughnut-shaped thin disk. The reason why the washer A is provided is to cause the washer A to function as a spacer for keeping the distance between the disk spring 64 and the slider 62 in conformity to an inclination of the contact portions with the balls 61 provided on the outer periphery of the slider 62, which are bent upward.

(Disk Spring 64)

Figure 15:
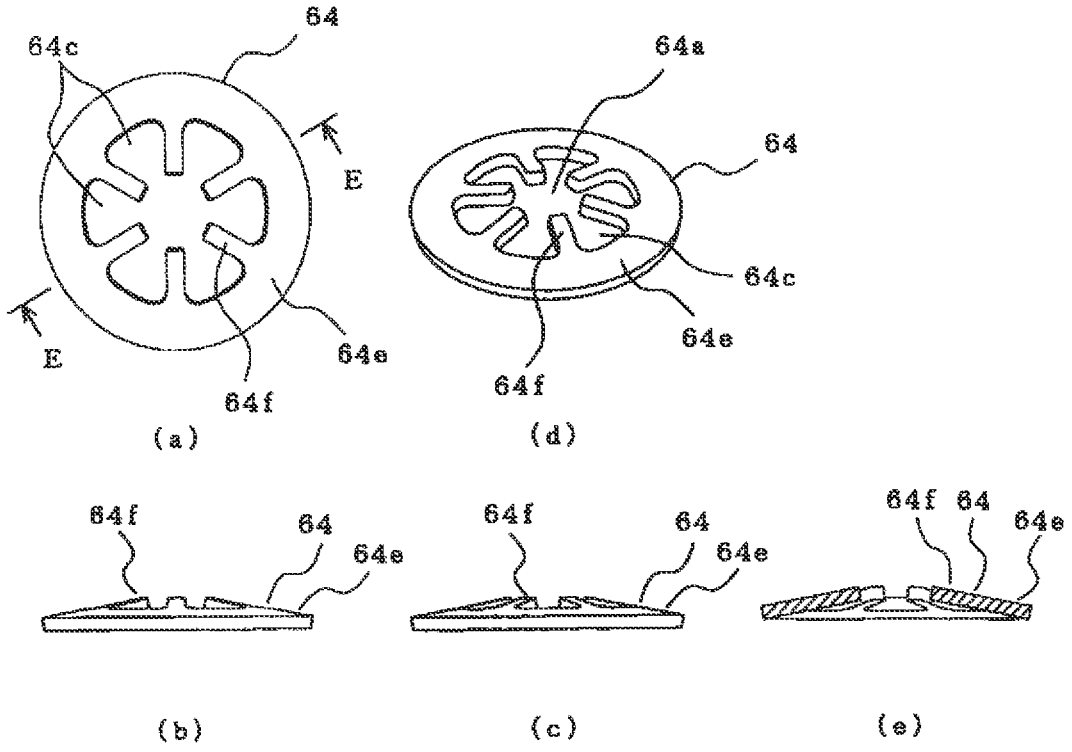
FIG. 15 shows a plan view, a front view, a side view, a perspective view, and a cross-sectional view taken along the line E-E of a disk spring shown in FIG. 11.

FIGS. 15(*a*) to (*e*) show a plan view, a front view, a right side view, a perspective view, and a cross-sectional view taken along the line E-E of the disk spring 64 in this embodiment.

The disk spring 64 includes the center through hole 64*a* at the center of the main body thereof, and is configured with an outer peripheral portion 64*e* which constitutes the periphery thereof (also referred to as a disk spring portion), and the projecting portion (beam portion) 64*f* projecting toward the center. The outer peripheral portion 64*e* functions as a portion to receive the load, and the projecting portions 64*f* provided on the inner peripheral portion thereof function as deflecting portions.

The disk spring 64 is provided with the six projecting portions 64*f* provided radially at regular intervals of 60°. The projecting portions 64*f*, as illustrated, are each formed to have substantially the same width (parallel) from the outer peripheral side to distal end thereof on the inner peripheral side, and the root thereof is formed into an arcuate shape and coupled to the outer peripheral portion 64*e*, so that the width is slightly larger than the distal end side. The distance between the distal ends of the projecting portions 64*f*, that is, the diameter of the through hole 64*a* has the same size as the through hole 64*a* in FIG. 9. Also, the outer peripheral portion 64*e* and the projecting portions 64*f* of the disk spring 64 are formed to be higher as they go toward the center (incline upward).

Formed between the adjacent projecting portions 64*f* are the through holes 64*c* having a fan shape widened on the outer peripheral side (triangle having an arcuate shape at corners on the outer peripheral side). The size of the through holes 64*c* is slightly smaller than the through hole 64*a* at the center, and the width on the outer peripheral side is larger than the width of the projecting portions 64*f*. However, the width of the inner peripheral side is formed to be substantially the same size as the width of the projecting portion 64*f*. A plurality of, for example, six of the through holes 64*c* are formed radially so as to continue to the through hole 64*a* located at the center.

As regards length in the direction of diameter of the disk spring 64, the length of the outer peripheral portion 64*e*, the length of the projecting portions 64*f*, and the length of the diameter of the through hole 64*a* at the center are substantially the same in a balanced manner. The disk spring 64 is divided into the projecting portions 64*f* and the disk spring portion on the outer peripheral portion 64*e*, and respective roles are provided so that the projecting portions 64*f* are in charge of the deflection (amount of displacement) and the disk spring portion 64*e* is in charge of the characteristics of the load.

Subsequently, four characteristic points of the disk spring 64 will be described.

(1) A point that the width of the projecting portions 64*f* is parallel.

If the shape of the width of the projecting portions 64*f* is tapered on the distal end side, the load tends to be reduced when the projecting portions 64*f* are deflected. The reason is that the root of the projecting portions 64*f* has a shape which can also work as the disk spring portion 64*e*, the deflection of the projecting portions 64*f* absorbs the deflection of the disk spring portion 64*e* and hence the load is reduced as a result. In this regard, the width of the projecting portions 64*f* is largest at the root portion, which is a coupled portion with respect to the outer peripheral portion 64*e*. Therefore, by forming portions on the distal end side to be parallel, the load is hardly reduced even when the projecting portions 64*f* is deflected. In other words, by dividing the respective roles completely so that the projecting portions 64*f* are in charge of the deflection (the amount of displacement) and the outer peripheral portion (disk spring portion) 64*e* is in charge of the characteristics of the load, the deflection of the projecting portions 64*f* does not affect the deflection of the outer peripheral portion 64*e*.

(2) A point that the width of the projecting portions 64*f* is smaller than the width of the through holes 64*c* on the outer periphery side.

If the width of the projecting portions 64*f* is larger than the diameter of the through holes 64*c*, a stress concentrates on the root of the projecting portions 64*f* when a large load (or a large stress) is applied, so that the probability of breakage is high. In contrast, when the projecting portions 64*f* are too small, the stress concentrates on the root of the projecting portions 64*f* in the same manner, so that the probability of breakage is also high. In this manner, the balance between the length and the width of the projecting portions 64*f* is important, and in the disk spring of the present invention, the width of the projecting portions 64*f* versus the length of the projecting portions 64*f* is set to 1:3 only as a guide.

(3) A point that the length of the projecting portions 64*f* and the length of the disk spring portion 64*e* on the outer peripheral side is almost the same.

If the length of the projecting portions 64*f* is short, the load becomes high but the amount of displacement becomes small. Also, if the length of the projecting portions 64*f* is longer than the outer peripheral portion 64*e*, the amount of displacement becomes large, but the load becomes small. Accordingly, in the disk spring in which the dimension of the outer diameter is limited, both of the high load and the high amount of displacement are achieved by substantially equalizing the lengths of the projecting portions 64*f* and the length of the outer peripheral portion 64*e*.

(4) A point that the distance between distal ends of the adjacent projecting portions 64*f* and the projecting portions 64*f* is on the order of half the distance between the projecting portions 64*f* and the rear end of the projecting portions 4*f* (on the outer periphery side of the through holes 64*c* (the arcuate portion)).

If the shape of the through holes 64*c* does not have a fan shape, it is contemplated that when a large load is applied, a stress concentrates on the root of the projecting portions 64*f*, and breakage occurs easily. What is important is to provide large arcs (rounding of the corner) at a joint portion between the projecting portions 64*f* and the disk spring portion 64*e* and, the stress can be dispersed by this arc. Also, by forming the shape of the through holes 64*c* into the shape having the arcs at the corners, the role of the projecting portions 64*f* and the outer peripheral portion 64*e* (the disk spring portion) can be divided clearly, and the disk spring portion having both of the high load and the high amount of displacement may be obtained.

The disk spring 64 is formed so as to be increased toward the center, and is configured to be clamped between the washer A and the washer B (see FIG. 11). With this configuration, even when three pieces of the disk springs of the related art are needed, the same function can be obtained with a single piece of the disk spring 64 owing to the configuration of the disk spring 64 by itself and the application of a uniform force.

(Set Screw 65)

The head portion of the set screw 65 is stored in the depression 32 on the bottom surface of the valve body 30. In the first embodiment, the gap between the outer periphery of the head portion of the set screw 65 and the inner periphery of the depression 32 of the valve body 30 is minute. However, a large gap 32A is formed in this embodiment. In addition, an end surface of the head portion of the set screw 65 is formed into a spherical surface, and the bottom surface of the depression 32 and a spherical surface portion are in contact with each other.

Also, the disk spring 64 fitted on the head portion of the set screw 65 is arranged at an outer peripheral edge on the side of the valve body 30 and an inner peripheral edge on the side of the slider 62.

Figure 16:
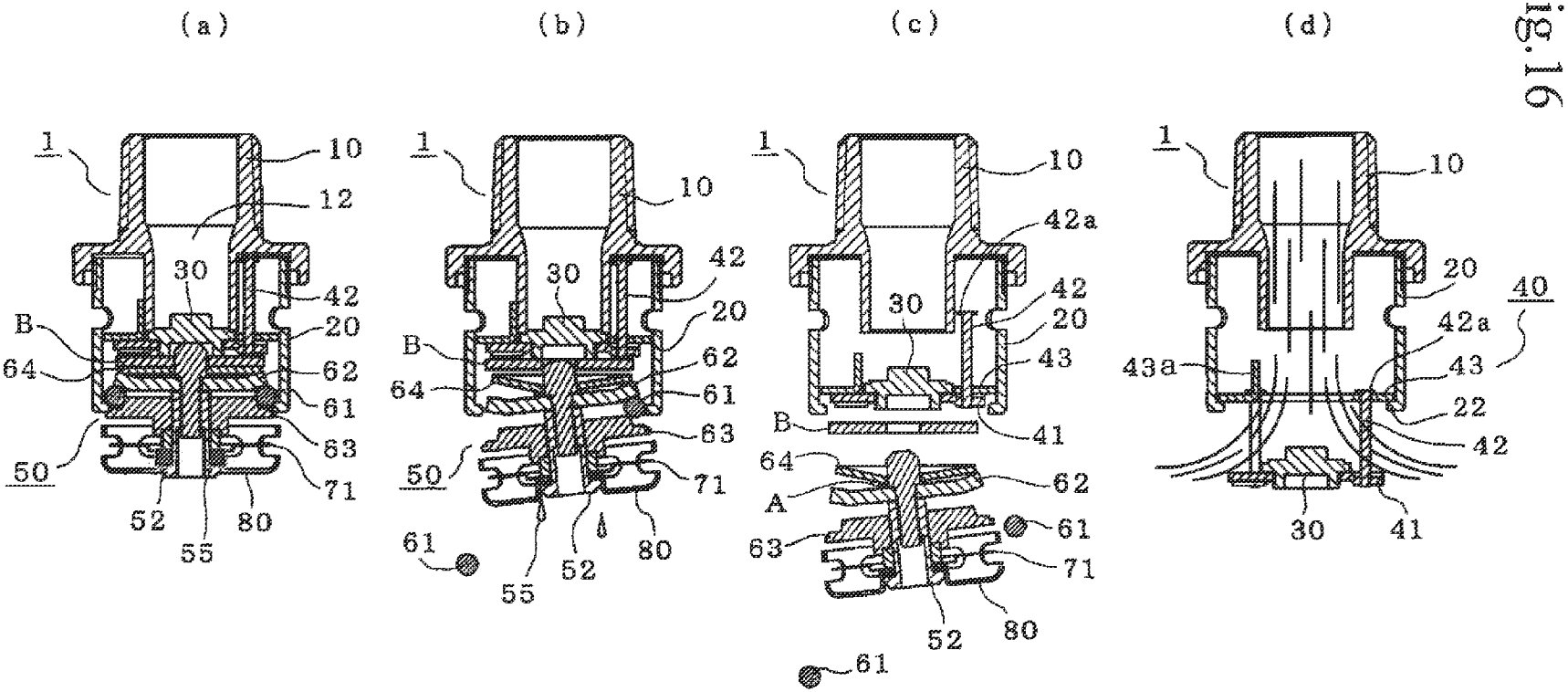
FIG. 16 illustrates cross-sectional views showing a state of operation of the sprinkler head shown in FIG. 11.

These configurations are just to allow the inclination of the set screw 65 in the interior of the depression 32. In other words, as shown in FIG. 16(*b*), when the ball holding mechanism 60 is operated in an inclined manner, since the head portion of the set screw 65 is a spherical surface portion, the frictional resistance with respect to the bottom surface of the depression 32 of the valve body 30 is reduced. Also, with the provision of the gap 32A between the head portion of the set screw 65 and the depression 32 of the valve body 30, the inclination of the set screw 65 in the interior of the depression 32 is achieved, and hence the set screw 65 can easily follow the inclination of the ball holding mechanism 60. Then, when the disk spring 64 is restored from the compressed state to a no-load state, the inclination of the ball holding mechanism 60 is absorbed and hence the inclination of the washer B is prevented. Accordingly, even when the set screw 65 is inclined, the closed state of the valve body 30 is maintained, and hence the valve body 30 is opened before the ball holding mechanism 60 is dropped off from the frame 20 thereby preventing water in the head body 10 from leaking from the water discharging cylinder 16.

Subsequently, the operation of the sprinkler head 1 in the second embodiment will be described. The basic operation is the same as the description in the first embodiment (paragraph 0044 to 0047), the operation on the basis of the configuration specific in the second embodiment will mainly be described. FIGS. 16(*a*) to (*d*) are drawings showing a process of operation of the sprinkler head 1.

(a) In the first embodiment, when the fire breaks out, the hot air hits on the thermosensitive plate 53 and heats up the same, and is c to the thermosensitive member 55. In contrast, in this embodiment, the thermosensitive plate 71 and the thermosensitive plate cover 80 hit against the hot air and thus heated, so that the heat is propagated to the thermosensitive member 55.

Then, when the thermosensitive member 55 starts to melt, the melted thermosensitive member 55 flows out from a gap formed between the plunger 52 and the thermosensitive plate cover 80 and the volume thereof is reduced.

At this time, the balls 61 pressed from above by the balancer 63 the slider 62 receives a force to cause the same inward, and even when the balancer 63 moves downward toward the thermosensitive cover 80 and the balls 61 move, the valve body 30 is brought into a press-contact with the valve seat 17, and a state of closing the water discharging port 12 is maintained. This occurs because of the action of the disk spring 64. The disk spring 64 is formed to be higher as it goes to the center, and is configured to be clamped between the washer A and the washer B, whereby the disk spring 64 has a stroke of a predetermined amount which can maintain the sealed state by the valve body 30. In this manner, the valve body 30 is prevented from coming apart from the valve seat 17 until the ball holding mechanism 60 is completely dropped, so that the reliable operation is ensured.

(b) When the thermosensitive member 55 is melted and flowed out to the outside, the thermosensitive plate cover 80 moves downward corresponding to the amount of outflow of the thermosensitive member 55. When the thermosensitive plate cover 80 moves downward, the heat insulating member 54 and the balancer 63 mounted on the thermosensitive plate cover 80 move downward. When the balancer 63 moves downward, the gap between the balancer 63 and the slider 62 is increased, so that the balls 61 urged inward move inward beyond the shoulder 63*b* of the balancer 63 to disengage the locking shoulder portion 22 of the frame 20 and the balls 61. Accordingly, the valve body 30 and the valve body supporting mechanism 50 move downward (FIG. 16(*b*)).

(c) When the valve body supporting mechanism 50 including the washer B, the disk springs 64, the washer A arranged below the valve body 30 drops, the valve body 30 moves downward. Also, in association with the downward movement of the valve body 30, the deflector 41 attached to the valve body 30, the guide rods 42 attached to the deflector 41, and the stopper ring 43 move downward (FIG. 16(*c*)).

(d) When the guide rods 42 move downward, the shoulder 42*a* provided on an upper portion thereof is locked with the stopper ring 43, and the stopper ring 43 is locked with the locking shoulder portion 22 of the frame 20, and the valve body 30 and the deflector 41 are brought into a state of being suspended from the frame 20 by the guide rods 42.

In this manner, when the valve body 30 moves downward, the water discharging port 12 is opened, and the pressurized fire service water is sprinkled via the deflector 41 and extinguishes the fire (FIG. 16(*d*)).

Figure 17:
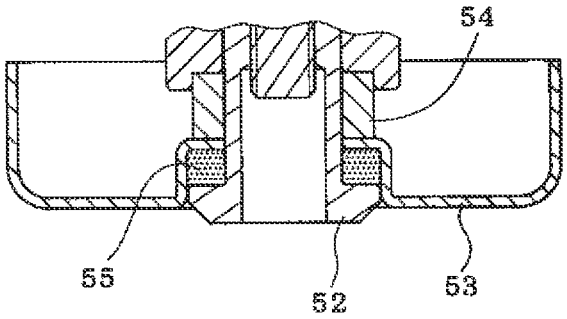
FIG. 17 is a partial enlarged view showing a modification of a thermosensitive portion.
Figure 18:
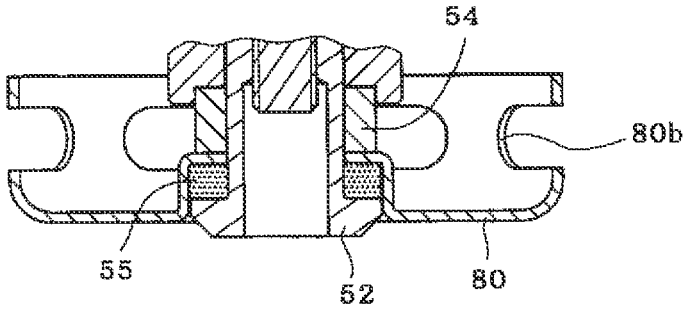
FIG. 18 is a partial enlarged view showing another modification of the thermosensitive portion.
Figure 19:
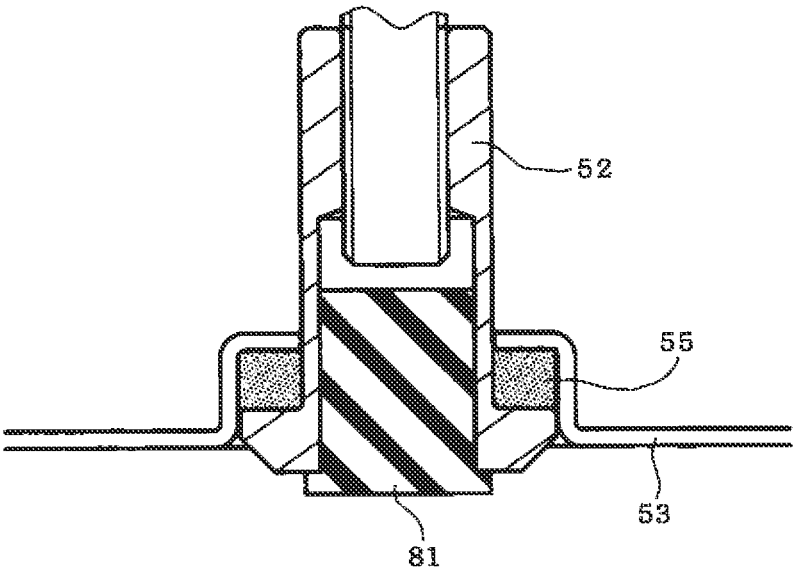
FIG. 19 is a partial enlarged view showing a plunger provided with a heat insulating member.

Modification of Embodiments [FIG. 17 to FIG. 19]

In the respective embodiments of the present invention, the embodiments are described with reference to the sprinkler head configured to support the valve body by the valve body supporting mechanism provided with the ball holding mechanism including the balls, the slider, and the balancer. However, the preset invention may be applied to a flash-type sprinkler head having a general-type piston which compress solder as a thermosensitive member, for example, a lever-type sprinkler head in which a pair of arms constitute the valve body supporting mechanism.

Also, although the valve body is brought into press-contact with the valve seat at a lower end of the water discharging cylinder, the valve body may be provided as the thermosensitive plate 53 inside the water discharging cylinder.

For reference, although only the stopper ring is attached to the guide rods in a slidable state, the deflector may also be mounted so as to be slidable with respect to the guide rods.

An example in which the slit-shaped opening portion 80*b* is provided on the peripheral wall of the thermosensitive plate cover 80 in the second embodiment has been described, a configuration in which the opening portion 80*b* is not provided as shown in FIG. 17 is also applicable. Although the embodiment in which the thermosensitive plate 71 is not provided is shown in FIG. 17, the thermosensitive plate 71 may be provided.

Also, in the second embodiment, the embodiment in which the thermosensitive plate 71 is provided is shown. However, an embodiment having no thermosensitive plate 71 as shown in FIG. 18 is also applicable.

In the embodiment described above, the example in which the plunger 52 is formed with a hole, and the hole is opened toward the outside is shown. However, a heat insulating member 81 configured to close the hole may be provided as shown in FIG. 19. In this manner, by providing the heat insulating member 81 which closes the hole of the plunger 52, a thinned portion of the plunger 52 can be reinforced and, in addition, the heat insulating effect is ensured, so that the sensitivity performances can be secured.

Also, the heat insulating member 81 is installed so as to project from the end surface of the plunger 52. Therefore, when a substance hits from below, the probability of hitting against the heat insulating member 81 projecting most is increased, so that the probability of deformation of the plunger 52 or the thermosensitive plate 53 which affects the operation at the time of extinguishing the fire is minimized.

For reference, the heat insulating member 81 shown in FIG. 19 may be installed on the plunger 52 in the second embodiment. Also, the heat insulating member 81 may be formed of a hard material, for example, a hard resin.

REFERENCE SIGNS LIST

1 sprinkler head, 10 head body, 11 opening portion, 12 water discharging port, 13 flange, 14, 15 screw portion, 16 water discharging cylinder, 17 valve seat, 18 space, 20 frame, 21 screw portion, 22 locking shoulder portion, 30 valve body, 31 flange portion, 32 depression, 40 sprinkling portion, 41 deflector, 41*a* insertion hole, 42 guide rod, 42*a* shoulder, 43 stopper ring, 43*a* guide member, 44 coil spring, 50 valve body supporting mechanism, 51 thermosensitive portion, 52 plunger, 52*a* flange portion, 52*b* female screw, 53 thermosensitive plate, 54 heat insulating member, 55 thermosensitive member, 60 ball holding mechanism, 61 ball, 62 slider, 62*a* depression, 63 balancer, 64 disk spring, 65 set screw, 71 thermosensitive plate, 80 thermosensitive plate cover, 81 heat insulating member

The invention claimed is:

1. A sprinkler head comprising:

a head body having a water discharging cylinder in the interior thereof;

a frame connected to the head body;

a valve body configured to close a water discharging port of the water discharging cylinder in the interior of the frame;

a thermosensitive portion configured to support the valve body; and a disk spring provided between the valve body and the thermosensitive portion, wherein a set screw configured to be coupled to the thermosensitive portion is provided below the valve body, the set screw includes a head portion for forming a gap for clamping the disk spring between the valve body and an opposing surface on the side of the thermosensitive portion opposing the valve body, a depression allowing insertion of the head portion of the set screw and having a gap which allows an inclining action of the head portion of the set screw at the time of a dismantling operation with respect to the head portion is provided at a bottom portion of the valve body opposing the head portion of the set screw, the disk spring is formed with a through hole at the center thereof, and the disk spring is held by inserting the set screw coupled to the thermosensitive portion into the through hole, and the through hole of the disk spring is formed such that a smallest diameter of the through hole is the same as or slightly larger than the outer diameter of the head portion of the set screw, the head portion of the set screw having a smooth outer peripheral surface.

2. The sprinkler head according to claim 1, wherein the set screw includes a head portion and a leg portion, and the head portion is formed to be taller in height than the height of arrangement of the disk spring held by the set screw.

3. The sprinkler head according to claim 1, wherein the disk spring includes a portion formed on an outer peripheral portion for receiving a load and a deflecting portion formed on an inner peripheral portion thereof.

4. The sprinkler head according to claim 1, wherein the disk spring includes a plurality of slits extending radially from the through hole as a center.

5. The sprinkler head according to claim 4, wherein the disk spring includes through holes that are triangular and formed into an arcuate shape at the corners thereof, the through holes being provided between adjacent ones of the slits.

6. The sprinkler head according to claim 1, wherein the head portion of the set screw is formed into an end chamfered shape or a curved surface shape.

7. The sprinkler head according to claim 1, wherein the disk spring has a shape protruding from the center side with respect to the outer peripheral portion, and is arranged with the surface on the protruding side facing the thermosensitive portion.

* * * * *